US011648570B2

(12) United States Patent
Riera Domenech

(10) Patent No.: US 11,648,570 B2
(45) Date of Patent: May 16, 2023

(54) SELF-CLEANING ROTARY VIEWING HOLE AND CENTRIFUGAL MACHINE PROVIDED WITH SAID ROTARY VIEWING HOLE

(71) Applicant: RIERA NADEU, S.A., Granollers (ES)

(72) Inventor: Marc Riera Domenech, Barcelona (ES)

( * ) Notice: Subject to any disclaimer, the term of this patent is extended or adjusted under 35 U.S.C. 154(b) by 554 days.

(21) Appl. No.: 16/491,979

(22) PCT Filed: Mar. 5, 2018

(86) PCT No.: PCT/EP2018/055384
§ 371 (c)(1),
(2) Date: Sep. 6, 2019

(87) PCT Pub. No.: WO2018/162433
PCT Pub. Date: Sep. 13, 2018

(65) Prior Publication Data

US 2020/0188938 A1 Jun. 18, 2020

(30) Foreign Application Priority Data

Mar. 7, 2017 (EP) ..... 17380009

(51) Int. Cl.
*B04B 15/06* (2006.01)
*B01F 35/00* (2022.01)
(Continued)

(52) U.S. Cl.
CPC ..... *B04B 15/06* (2013.01); *B01F 35/00* (2022.01); *B04B 7/02* (2013.01); *B63B 19/02* (2013.01); *B63B 2019/0007* (2013.01)

(58) Field of Classification Search
CPC . B04B 15/06; B04B 7/02; B01F 15/00; B63B 19/02; B63B 2019/0007
(Continued)

(56) References Cited

U.S. PATENT DOCUMENTS

2002/0090729 A1* 7/2002 Neeper ..... B01L 3/0293 436/45
2013/0039461 A1* 2/2013 Rustad ..... G01N 23/12 378/54

FOREIGN PATENT DOCUMENTS

CN 204602419 U 9/2015
DE 3407612 A1 * 2/1985 ..... B63B 19/02
(Continued)

OTHER PUBLICATIONS

DE 3407612 Description Espacenet Machine Translation.*

*Primary Examiner* — Shuyi S. Liu
(74) *Attorney, Agent, or Firm* — Eugenio J. Torres-Oyola; Victor M. Rodriguez-Reyes; Rafael Rodriguez-Muriel

(57) ABSTRACT

The present invention relates to a fluid treatment chamber with a self-cleaning rotary sight window. The proposed rotary sight window includes a stationary frame (10); a transparent stationary panel (11) attached to the stationary frame by a leak-tight joint (41); a rotary frame (20) connected to the stationary frame (10) by a rotary joint (40); a transparent rotary panel (21) attached to the rotary frame (20) by a joint, the transparent rotary panel (21) being arranged opposite and spaced apart from the transparent stationary panel (11) by an intermediate chamber (1); and a motor (30) connected to the transparent rotary panel (21) or to the rotary frame (20), wherein the joint between the transparent rotary panel (21) and the rotary frame (20) is an interference joint (43) attached by a dimensional interference fit.

9 Claims, 4 Drawing Sheets

(51) Int. Cl.
*B04B 7/02* (2006.01)
*B63B 19/02* (2006.01)
*B63B 19/00* (2006.01)

(58) Field of Classification Search
USPC ..... 494/38, 41
See application file for complete search history.

(56) References Cited

FOREIGN PATENT DOCUMENTS

| | | | | |
|---|---|---|---|---|
| DE | 3407612 | A1 | 2/1985 | |
| DE | 102010061587 | A1 | 6/2012 | |
| DE | 102008045793 | A1 | 5/2017 | |
| EP | 0144062 | A2 * | 6/1985 | ..... B04B 7/02 |
| EP | 0144062 | A2 | 6/1985 | |

* cited by examiner

SELF-CLEANING ROTARY VIEWING HOLE AND CENTRIFUGAL MACHINE PROVIDED WITH SAID ROTARY VIEWING HOLE

FIELD OF THE ART

The present invention relates to the field of a fluid treatment chamber, typically of a centrifugal machine, with a rotary sight window attached to its casing. A wide range of chemical products are used in centrifugation processes. These chemical products are driven outward due to the rotation and speed of the centrifuges, dirtying the glass panes of the sight window and making the viewing of the process difficult.

The rotary sight window of this invention is provided with a transparent rotary panel located inside the centrifugal machine, connected to a motor causing the rotation thereof. The glass panel rotational speed prevents the adherence of splashes of chemical products, chemical product particles or droplets and the visibility is perfect throughout the entire centrifugation process.

STATE OF THE ART

Self-cleaning rotary sight window known in the field of the art consist of a transparent circular panel connected to a rotary frame and to a motor causing the rotation thereof, which pushes out any impurity that may be deposited on its surface, keeping the sight window free of impurities and therefore maintaining its visibility.

Rotary sight windows of this type are known particularly in the field of watercrafts, where the windows of the navigation bridge of the watercraft are usually equipped with rotary sight windows for maintaining visibility even in rainy or stormy conditions, said rotary sight windows being free of water and therefore maintaining a much greater visibility than the rest of the windows of the navigation bridge.

The use of rotary sight windows of this type in machine tools is also known through patent document DE102008045793A1, for example.

Patent document DE102010061587A1 also describes a rotary sight window, in this case provided with a particular construction for rotatably operating the rotary glass pane.

Also patent document DE3407612A1 describe a rotatory sight window having a circular glass pane attached to its frame with a sealing material there between, and being adapted for its use in a window of a ship's bridge where said sealing material will not be in contact with solvents. On FIG. 5 of this document a cross-section of the attachment between the glass pane and the frame is shown wherein the frame has an annular protrusion preventing the glass pane to be introduced into the frame in a direction perpendicular to the rotation axis of the glass pane. As this protrusion reduces the size of the access opening of the frame it will not allow the insertion of the glass pane within a closed single piece annular frame.

None of the known background documents describes a solution which allows leak-tight fixing of the rotary glass pane to the rotary frame containing it with a precise centering that prevents vibrations and without using adhesives that may deteriorate upon contact with solvents and become detached over time. There is also no knowledge of anyone having provided an inertization system for any of the mentioned sight windows which allows using them in potentially explosive atmospheres and allows them to be ATEX standard-compliant and ATEX-certified, i.e., providing in the sight window means for preventing the entry of oxygen and any other product from the outside which may cause an explosion.

BRIEF DESCRIPTION OF THE INVENTION

According to a first aspect, the present invention relates to a self-cleaning rotary sight window for a centrifugal machine or processing equipment which may have the same problems as those described.

It will be understood that a centrifugal machine is a machine provided for mechanically separating a solid and a liquid, or for separating particles suspended in a liquid by means of high-speed centrifugation. A typical example of centrifuges of this type consists of machines intended for separating active ingredients resulting from a precipitate or crystallization before a chemical reaction.

In this case, the proposed rotary sight window includes:

- a stationary frame;
- a transparent stationary panel or glass pane attached to said stationary frame by means of a leak-tight joint;
- a transparent rotary panel or glass pane, integral with a rotary outer frame, attached, at the center, for example, to a motor with a coupling fixing and drive system, said transparent rotary panel being arranged opposite and spaced apart from the transparent stationary panel by means of an intermediate chamber;
- a motor connected to said transparent rotary panel or glass pane or to said frame to cause the rotation thereof with respect to the stationary frame about a central axis of rotation perpendicular to said transparent rotary panel, a rotary joint having been provided between the rotary frame and the stationary frame.

In other words, the transparent rotary panel and the rotary frame are attached forming a first assembly which, when operated by a motor, rotates with respect to a second assembly formed by the stationary frame and the transparent stationary panel, both first and second assemblies being connected through the mentioned rotary joint.

It will be understood that both the transparent rotary panel and the transparent stationary panel could be made from any transparent material, such as, for example, glass, methacrylate or another transparent plastic compatible with the inner atmosphere of the machine or processing equipment to be isolated or confined.

The present invention proposes a third leak-tight joint providing that the attachment between the transparent rotary panel and the rotary frame.

The present invention proposes the third leak-tight joint to be an interference attachment interference between a transparent rotary panel perimetral face and a rotary frame coupling face facing said transparent rotary panel perimetral face, the transparent rotary panel being fitted into the rotary frame.

It will be understood that an interference joint attached by means of a dimensional interference fit is a fit produced when the transparent rotary panel has a size larger than the cavity defined by said rotary frame coupling face before the coupling thereof, such that after coupling, the transparent rotary panel is compressed by the rotary frame, and said rotary frame is elastically pulled all around, assuring a secure and leak-tight attachment without requiring the use of adhesives. Said size difference between the transparent rotary panel and the rotary frame will be preferably equal or smaller than 3 mm.

According to a preferred embodiment the rotary frame is a closed single piece annular frame.

To achieve said dimensional interference fit between the transparent rotary panel and the rotary frame, it is proposed to heat the perimetral frame, causing it to expand, and cool the transparent rotary panel, causing it to shrink, which thereby allows introducing the transparent rotary panel into the cavity defined by the rotary frame coupling face, leaving a clearance between both which will disappear when the two elements reach one and the same temperature, the transparent rotary panel being snap-fitted into the rotary frame.

It will be understood that the transparent rotary panel perimetral face is that face or faces of the transparent rotary panel connecting its two opposite main faces.

This proposed solution allows assuring a perfect centering between the rotary frame and the transparent rotary panel as there is no space to be filled with adhesive which may allow an off-center adhesion of the transparent rotary panel with respect to the rotary frame.

Furthermore, since the proposed solution lacks adhesive, it prevents the deterioration of said adhesive from being able to lead to the release of the transparent rotary panel, causing a possible accident. Another additional advantage of the proposal is that it allows using said rotary sight window in contact with environments in which various solvent or corrosive agents or chemical products that may degrade said adhesive are present (like what occurs inside a centrifuge).

According to an additional embodiment, it is proposed for the transparent rotary panel to be circular. In such case, it is proposed for the transparent rotary panel perimetral face and the rotary frame coupling face to be both cylindrical and concentric with said axis of rotation. This assures that both faces are arranged opposite one another such that the compressive force of the transparent rotary panel described above is uniformly distributed and keeps the transparent rotary panel in place. Preferably, the transparent rotary panel perimetral face is a rectified perimetral face and the rotary frame coupling face is a rectified coupling face, i.e., they have been worked with machine tools until obtaining precise dimensions within established tolerances. This allows assuring that their dimensions are the required dimensions according to the diameter.

It is further proposed for the rotary joint to be a labyrinth seal. This allows smooth, frictionless rotation between the rotary frame and the stationary frame.

The intermediate chamber contains a modified atmosphere supplied by a nitrogen line connected to said intermediate chamber when the products are processed with a solvent. Said modified atmosphere supply device can also be treated air (when not working with solvents). A positive pressure inside the sight window prevents the passage of air, gases, fluids or particles towards the intermediate chamber. Excess gas from inside the intermediate chamber is released through the labyrinth seal, contributing to maintaining the inert atmosphere inside the centrifuge.

The stationary frame is attached to the machine by means of screws from the outside and a leak-tight joint to a casing or manifold, the transparent rotary panel being in contact with the inside of said manifold of the machine. By way of example, said chamber can be the inside of a centrifuge, which thereby allows observing the inside of a centrifuge basket from the outside during the entire batch or centrifugation process.

The inside of the equipment can be configured for treating fluid solvents, i.e., it can include a duct for supplying solvents into said fluid treatment chamber, said solvents being used in the process. In this case, the vapors released by the solvents or the direct contact between said solvents and an adhesive may degrade the mentioned adhesive, so not using adhesives for fixing the transparent rotary panel is particularly beneficial and relevant in this case.

It is further proposed for the inside of the equipment where the rotary sight window is mounted to contain a modified atmosphere which is inert as a result of an inertization system, provided by an oxygen-free atmosphere, for example.

Given that the intermediate chamber of the rotary sight window contains, as indicated, a modified atmosphere and a positive pressure from inside to outside through the labyrinth, there can be no leaks towards the inside.

An important point lies in the fact that the modified atmosphere contained in the intermediate chamber will be at a pressure greater than the pressure of the modified atmosphere contained in the fluid treatment chamber, thereby assuring that any possible leaks through the rotary joint will always occur from the intermediate chamber to the fluid treatment chamber, thereby preventing the entry of products from the centrifuge.

It is also proposed for the stationary frame to be divided into a first stationary frame, intended for being anchored to the centrifugal machine by means of a leak-tight joint and for being connected to the rotary frame through the rotary joint, and a second stationary frame attached to the transparent stationary panel through a leak-tight joint. This configuration allows removing the rotary sight window assembly like a cartridge for intermediate chamber and transparent rotary panel cleaning, maintenance or inspection tasks.

According to a second aspect, the present invention relates to a centrifugal machine provided with a self-cleaning rotary sight window, wherein it is proposed for the mentioned rotary sight window to include all the features described above.

It will also be understood that the end values of any offered range of values may not be optimum and this range of values may require adaptations of the invention so that said end values are applicable, said adaptations being within the reach of a person skilled in the art.

Other features of the invention will be described in the following detailed description of an embodiment.

BRIEF DESCRIPTION OF THE DRAWINGS

The foregoing and other advantages and features will be better understood based on the following detailed description of an embodiment in reference to the attached drawings which must be interpreted in an illustrative and non-limiting manner, in which.

DETAILED DESCRIPTION OF AN EMBODIMENT

Figure 1:
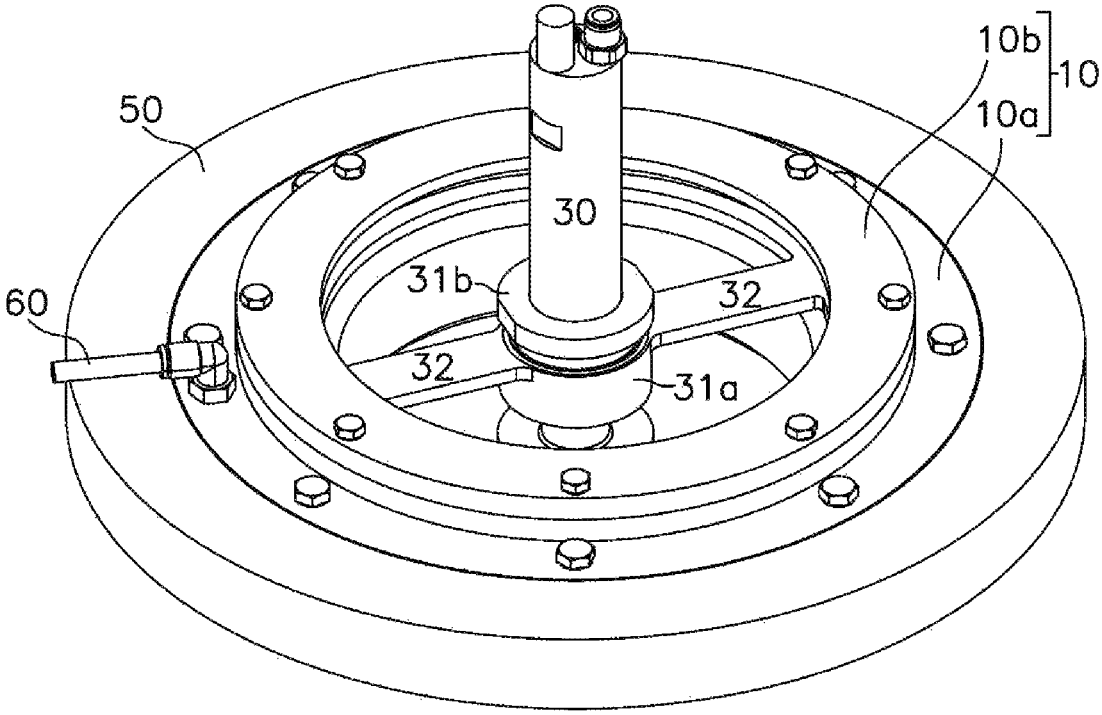
FIG. 1 shows a perspective view of the proposed rotary sight window, seen from the side of its transparent stationary panel, and anchored to a casing portion of a centrifugal machine, shown herein in a simplified manner in the form of a ring.
Figure 2:
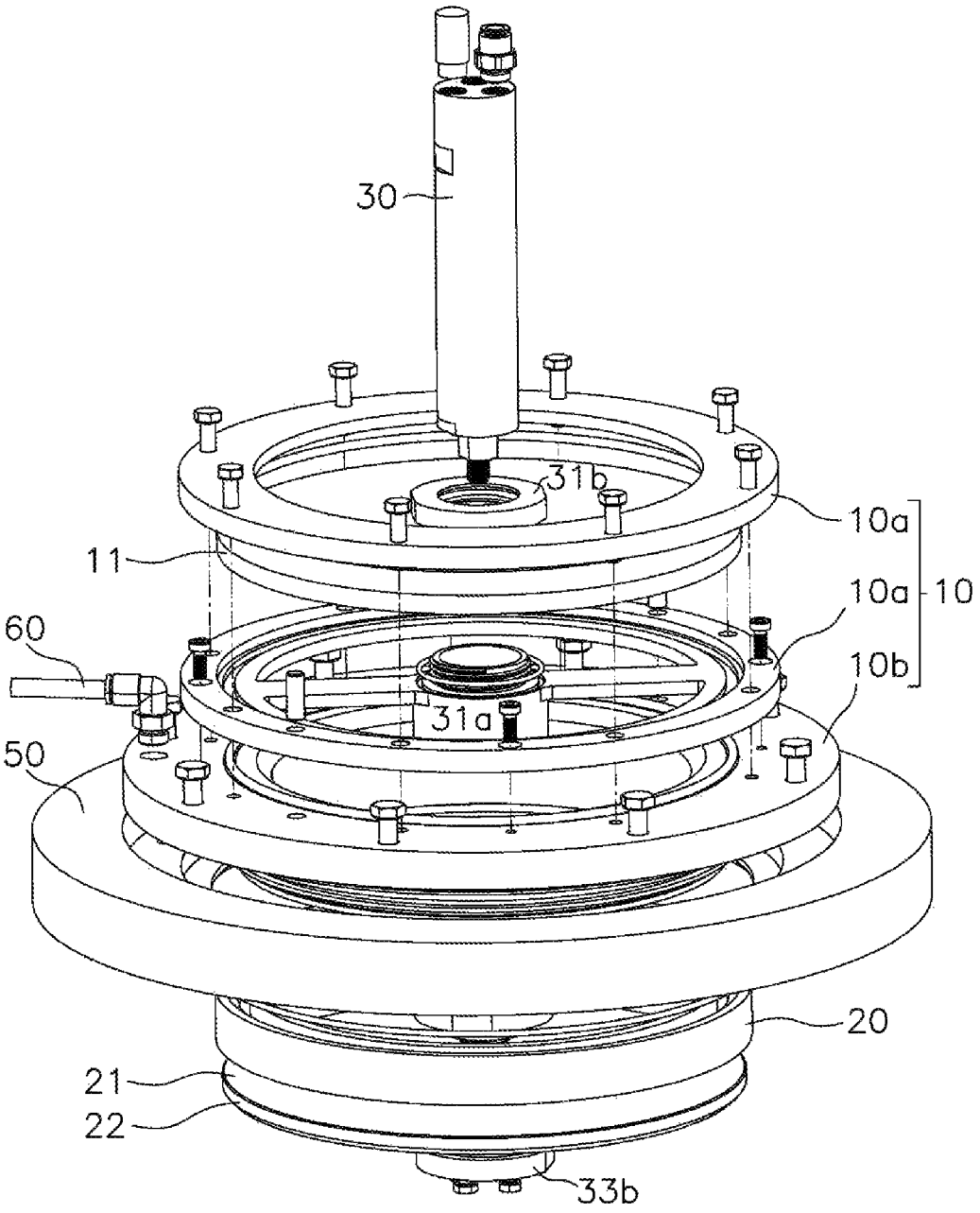
FIG. 2 shows an exploded view of the rotary sight window shown in FIG. 1.
Figure 3:
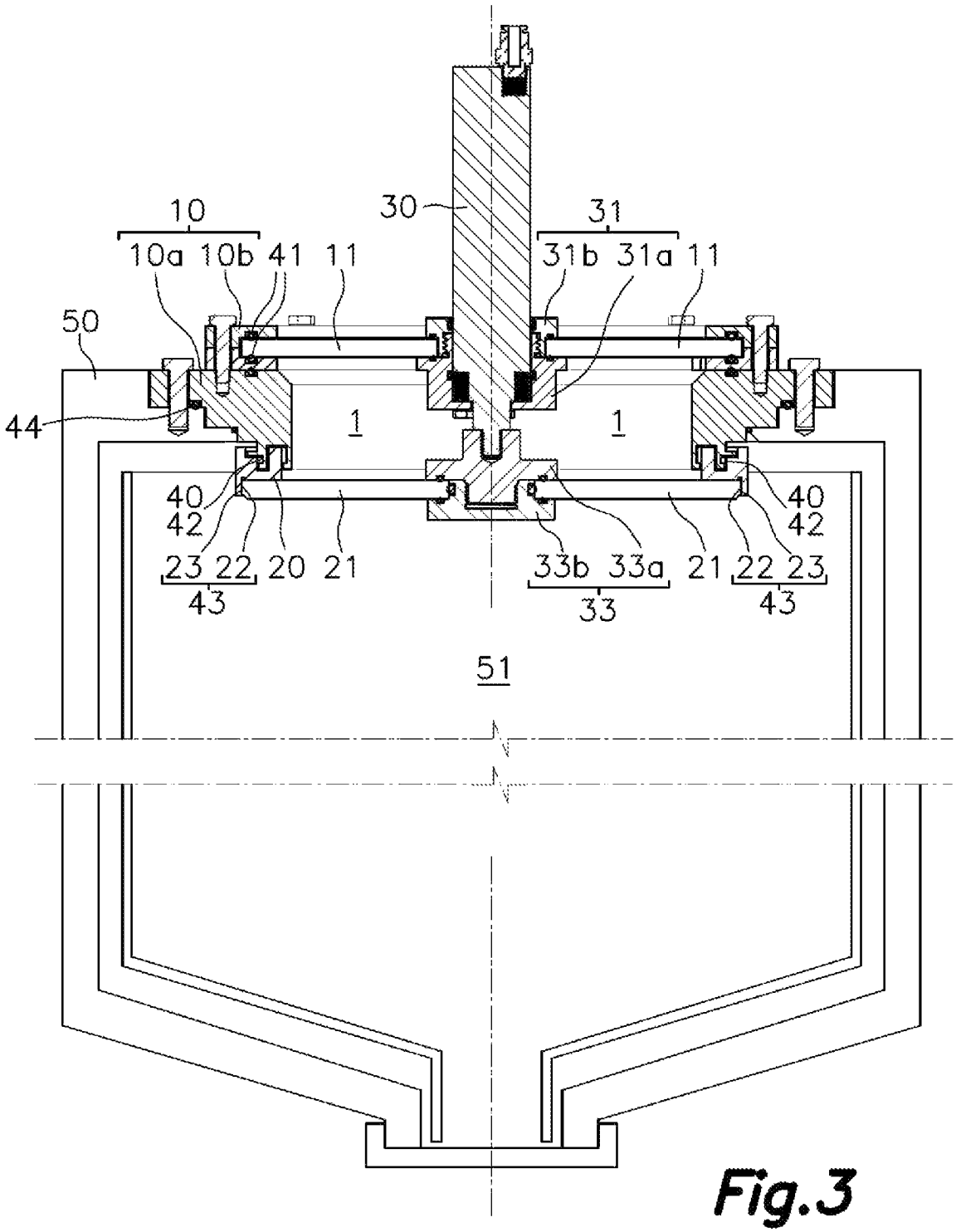
FIG. 3 shows a cross-section along the axis of the rotary sight window, said sight window being connected to the casing of a centrifugal machine provided with a fluid treatment chamber schematically shown in a simplified manner.
Figure 4:
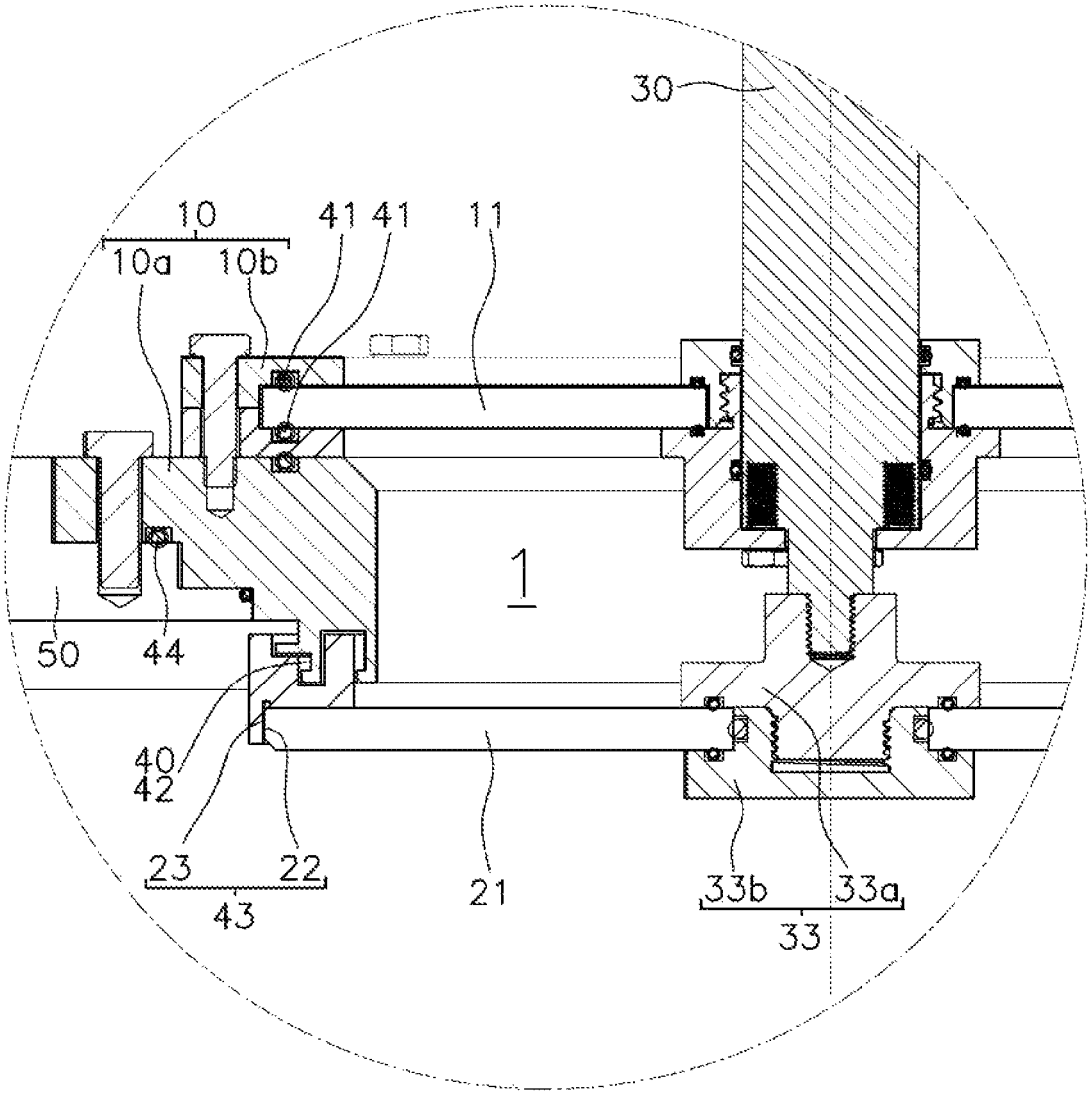
FIG. 4 shows a zoomed view of the cross-section shown in FIG. 3.

The attached drawings show an illustrative and non-limiting embodiment of the present invention.

According to that embodiment, the proposed self-cleaning rotary sight window for a centrifugal machine consists of a stationary frame 10 formed by a first annular stationary frame 10*a* and a second annular stationary frame 10*b* superimposed on one another.

The first annular stationary frame 10*a* is intended for being fixed around an opening in the casing 50 of a centrifugal machine provided with a fluid treatment chamber 51 by means of a first leak-tight joint 44, for example, in the form of one or two elastic rings pressed between said first stationary frame 10 and the casing 50 of the centrifugal machine, the first stationary frame 10*a* being fixed by means of screws. Preferably, the screws will be placed outside the area demarcated by said elastic rings, thereby assuring that the screws do not lead to the first leak-tight joint 44 breaking.

The second stationary frame 10*b* consists of two halves which, when attached, define an annular channel in which the perimeter of a circular transparent stationary panel 11 is fitted. The attachment between the transparent stationary panel 11 and the second stationary frame 10*b* also consists of a second leak-tight joint 41, for example, in the form of one or two elastic rings pressed between said second stationary frame 10*b* and the transparent stationary panel 11. Several screws fix said second stationary frame 10*b* to the first stationary frame 10*a* in a leak-tight manner by means of a second leak-tight joint 41 in the form of an elastic ring.

Each of said first and second leak-tight joints 44 and 41 will preferably include said elastic ring inserted into an annular groove provided for such purpose.

The rotary sight window further includes an annular rotary frame 20 connected to said first annular stationary frame 10*a* through a rotary joint 40.

Said rotary joint 40 consists of a labyrinth 42, in the form of a plurality of lubrication-free circular channels in which a plurality of circular flanges are fitted, thereby guiding a rotational movement of the rotary frame 20 while at the same time making the passage of fluids and gases through said rotary joint 40 difficult as a result of the labyrinthine configuration of the labyrinth seal 42.

The rotary frame 20 is in turn connected to a flat, circular transparent rotary panel 21 through third leak-tight joint 43. Said third leak-tight joint 43 is made up of a circular stepped recess in the entire inner perimeter of the rotary frame, defining a cylindrical-shaped rotary frame coupling face 23, said rotary frame coupling face 23 being arranged opposite an also cylindrical transparent rotary panel perimetral face 22.

The transparent rotary panel 21 and the rotary frame 20 have been rectified by means of cutting and/or polishing tools until the outer diameter of the transparent rotary panel 21, defined by said transparent rotary panel perimetral face 22, is slightly greater than the inner diameter of the cavity defined by the rotary frame coupling face 23 before coupling and at room temperature. The rotary frame 20 is then heated, causing it to expand, and the transparent rotary panel 21 is cooled, causing it to shrink, thereby allowing the transparent rotary panel 21 to be loosely inserted into the cavity defined by the rotary frame coupling face 23. The subsequent thermal equalization will cause the rotary frame 20 to shrink and the transparent rotary panel 21 to expand, the transparent rotary panel 21 thus being fitted into and pressed by the rotary frame 20, producing hermetic sealing between both without requiring the use of any kind of adhesives.

The transparent rotary panel 21 and the transparent stationary panel 11 are arranged parallel to and spaced apart from one another by an intermediate chamber 1.

To cause the rotation of the transparent rotary panel 21, it is proposed to include a motor 30, for example, a pneumatic motor, connected to said transparent rotary panel 21. In the present embodiment, the motor 30 is arranged at least partially outside the intermediate chamber 1, and going through the transparent stationary panel 11 through a circular central opening by means of a stationary connector 31, with a leak-tight joint such as those first and second leak-tight joints 44 and 41 described above formed by annular elastic joints, said motor being fixed to said circular central opening.

In this embodiment, said stationary connector 31 consists of a first stationary connector 31*a* arranged inside the intermediate chamber 1 and linked to the first stationary frame 10*a* by means of two radial arms 32, and a second stationary connector 31*b* screwed on the first stationary connector 31*a* from outside the intermediate chamber 1 through said central opening of the transparent stationary panel 11, the motor 30 being supported and centered by means of said stationary connector 31.

A rotor shaft which is connected to the center of the transparent rotary panel 21 projects from the end of the motor 30, such that the operation of the motor 30 causes rotation of its rotor shaft and the resulting rotation of the transparent rotary panel 21 together with its corresponding rotary frame 20. It is proposed for said connection with the transparent rotary panel 21 to be done by means of a rotary connector 33, with a leak-tight joint such as those first and second leak-tight joints 44 and 41 described above formed by annular elastic joints, being fixed to a circular central opening of the transparent rotary panel 21. Said rotary connector 33 can consist of a first rotary connector 33*a* arranged inside the intermediate chamber 1 and centered with respect to the circular central opening, attached to a second rotary connector 33*b* arranged on the opposite side of the transparent rotary panel 21 and attached to the first rotary connector 33*a* through said central opening of the transparent rotary panel 21, for example, by means of a thread. In such case, the direction of rotation of the transparent rotary panel and the direction for loosening said threaded attachment will be opposite directions.

It is further proposed to include a conduit 60 in connection with a modified atmosphere supply device and with said intermediate chamber 1, such that it allows introducing a modified atmosphere inside the intermediate chamber 1, preferably an inert atmosphere, such as a pressurized nitrogen atmosphere, to prevent the entry of oxygen and any other product from the outside which may cause an explosion.

The proposed rotary sight window is anchored to the casing 50 of a centrifugal machine provided with a fluid treatment chamber 51, in this case a centrifugation treatment chamber. Said fluid treatment chamber 51 will also contain a modified atmosphere supplied through ducts from said modified atmosphere supply device, preferably at a pressure less than the pressure of the modified atmosphere contained in the intermediate chamber of the rotary sight window.

The modified atmosphere contained inside the intermediate chamber will leak little by little through the labyrinth 42 into the fluid treatment chamber 51, preventing the fluid treatment chamber 51 from contaminating the inside of the intermediate chamber 1.

The invention claimed is:

1. A fluid treatment chamber with a self-cleaning rotary sight window, the self-cleaning rotary sight window including:

a stationary frame attached to a casing of the fluid treatment chamber by a first leak-tight joint;

a rotary frame connected to the stationary frame by a rotary joint;

a transparent stationary panel attached to the stationary frame by a second leak-tight joint;

a transparent rotary panel, arranged opposite and spaced apart from the transparent stationary panel by an intermediate chamber, fitted into the rotary frame by a third leak-tight joint and in contact with the inside of the fluid treatment chamber, the intermediate chamber containing a modified atmosphere at a positive pressure above the pressure of the fluid treatment chamber, assuring a modified atmosphere leakage towards the fluid treatment chamber through the rotary joint;

a modified atmosphere supply device connected to the intermediate chamber to provide and maintain the modified atmosphere at the positive pressure;

a motor connected to the transparent rotary panel or to the rotary frame to cause the rotation thereof with respect to the stationary frame about an axis of rotation perpendicular to the transparent rotary panel.

2. The fluid treatment chamber with rotary sight window according to claim 1, wherein the transparent rotary panel is circular.

3. The fluid treatment chamber according to claim 1 wherein the transparent rotary panel is shrink-fitted into the rotary frame, the rotary frame is pre-loaded around the transparent rotary panel, and the transparent rotary panel compressed by the rotary frame, providing the third leak-tight joint in a secure and leak-tight adhesive free manner between a perimetral face of the transparent rotary panel and a coupling face of the rotary frame facing the perimetral face of the transparent rotary panel.

4. The fluid treatment chamber with rotary sight window according to claim 3, wherein the transparent rotary panel perimetral face and the rotary frame coupling face are both cylindrical and concentric with the axis of rotation.

5. The rotary fluid treatment chamber with rotary sight window according to claim 3, wherein the transparent rotary panel perimetral face and the rotary frame coupling face are faces rectified to precise dimensions within established tolerances.

6. The fluid treatment chamber with rotary sight window according to claim 1, wherein the rotary joint is a labyrinth seal.

7. The fluid treatment chamber with rotary sight window according to claim 1, wherein the fluid treatment chamber is configured for treating fluid solvents.

8. The fluid treatment chamber with rotary sight window according to claim 1, wherein the fluid treatment chamber further contains the modified atmosphere supplied by the modified atmosphere supply device connected to the fluid treatment chamber.

9. The fluid treatment chamber with rotary sight window according to claim 8, wherein the modified atmosphere contained in the intermediate chamber is at a pressure greater than the pressure of the modified atmosphere contained in the fluid treatment chamber.

* * * * *